US009925586B2

(12) United States Patent
Rathner

(10) Patent No.: US 9,925,586 B2
(45) Date of Patent: Mar. 27, 2018

(54) METHOD FOR CASTING A CAST PART

(71) Applicant: Fill Gesellschaft m.b.H., Gurten (AT)

(72) Inventor: Wolfgang Rathner, Ried/Innkreis (AT)

(73) Assignee: Fill Gesellschaft m.b.H., Gurten (AT)

( * ) Notice: Subject to any disclaimer, the term of this patent is extended or adjusted under 35 U.S.C. 154(b) by 0 days.

(21) Appl. No.: 15/103,400

(22) PCT Filed: Jan. 2, 2015

(86) PCT No.: PCT/AT2015/050001
§ 371 (c)(1),
(2) Date: Jun. 10, 2016

(87) PCT Pub. No.: WO2015/100465
PCT Pub. Date: Jul. 9, 2015

(65) Prior Publication Data

US 2016/0311017 A1 Oct. 27, 2016

(30) Foreign Application Priority Data

Jan. 3, 2014 (AT) ..... A 50003/2014

(51) Int. Cl.
*B22D 1/00* (2006.01)
*B22D 21/00* (2006.01)
(Continued)

(52) U.S. Cl.
CPC ..... *B22D 39/026* (2013.01); *B22D 1/002* (2013.01); *B22D 21/007* (2013.01);
(Continued)

(58) Field of Classification Search
CPC ..... B22D 1/00; B22D 1/002; B22D 21/00; B22D 21/007; B22D 23/006; B22D 27/00;
(Continued)

(56) References Cited

U.S. PATENT DOCUMENTS 5,704,413 A 1/1998 Takasaki et al.
8,141,616 B2 * 3/2012 Iwasa et al. ..... B22D 23/006 164/136
(Continued)

FOREIGN PATENT DOCUMENTS

CN 101607308 A 12/2009
CN 102712041 A 10/2012
(Continued)

OTHER PUBLICATIONS

International Search Report of PCT/AT2015/050001, dated May 21, 2015.
(Continued)

*Primary Examiner* — Kevin P Kerns
(74) *Attorney, Agent, or Firm* — Collard & Roe, P.C.

(57) ABSTRACT

A method for casting a cast part according to the tilt pouring principle includes pouring a molten metal from at least one tiltable casting vessel into a casting mold including a mold cavity which forms the cast part. The molten metal is ladled directly out of a bale-out furnace using the casting vessel, and a metal oxide skin forms in the casting vessel on the surface of the molten metal. The casting vessel containing the molten metal and the metal oxide skin floating thereon is brought to the casting mold. The molten metal is poured from the casting vessel into the casting mold by a common rotation of the casting vessel and casting mold about an axis of rotation. The metal oxide skin rises to the top of the molten metal during the pouring process, floating predominantly on top and on the surface of the molten metal.

20 Claims, 4 Drawing Sheets

(51) Int. Cl.

| | |
|---|---|
| ***B22D 27/00*** | (2006.01) |
| ***B22D 33/02*** | (2006.01) |
| ***B22D 39/02*** | (2006.01) |
| ***B22D 41/04*** | (2006.01) |
| ***B22D 23/00*** | (2006.01) |
| ***B22D 47/00*** | (2006.01) |
| ***C22C 21/02*** | (2006.01) |

(52) U.S. Cl.
CPC ..... *B22D 23/006* (2013.01); *B22D 27/003* (2013.01); *B22D 33/02* (2013.01); *B22D 41/04* (2013.01); *B22D 47/00* (2013.01); *C22C 21/02* (2013.01)

(58) Field of Classification Search
CPC ..... B22D 27/003; B22D 33/02; B22D 39/02; B22D 39/026; B22D 41/04; B22D 47/00
USPC ..... 164/130, 136, 336
See application file for complete search history.

(56) References Cited

U.S. PATENT DOCUMENTS

| | | | | |
|---|---|---|---|---|
| 8,245,759 | B2 | 8/2012 | Goettsch | |
| 8,302,659 | B2 | 11/2012 | Smetan et al. | |
| 8,770,264 | B2 * | 7/2014 | Lange et al. | B22D 23/006 164/136 |
| 9,545,666 | B2 * | 1/2017 | Calin et al. | B22D 23/006 164/136 |
| 2012/0325424 | A1 | 12/2012 | Morikawa et al. | |

FOREIGN PATENT DOCUMENTS

| | | | |
|---|---|---|---|
| CN | 102990040 | A | 3/2013 |
| CN | 103038002 | A | 4/2013 |
| CN | 105704413 | A | 6/2016 |
| DE | 686 764 | C | 1/1940 |
| DE | 2 164 755 | A1 | 7/1973 |
| DE | 10 2006 058 142 | A1 | 6/2008 |
| DE | 10 2009 023 881 | A1 | 1/2010 |
| GB | 1 164 173 | A | 9/1969 |
| JP | H06-304695 | A | 11/1994 |
| WO | 2010/058003 | A1 | 5/2010 |
| WO | 2010/068113 | A1 | 6/2010 |
| WO | 2013/017371 | A1 | 2/2013 |

OTHER PUBLICATIONS

Response to European Patent Office dated Nov. 3, 2015 regarding PCT/AT2015/050001 with English translation of relevant parts.

* cited by examiner

METHOD FOR CASTING A CAST PART

CROSS REFERENCE TO RELATED APPLICATIONS

This application is the National Stage of PCT/AT2015/050001 filed on Jan. 2, 2015, which claims priority under 35 U.S.C. § 119 of Austrian Application No. A 50003/2014 filed on Jan. 3, 2014, the disclosures of which are incorporated by reference. The international application under POT article 21(2) was not published in English.

BACKGROUND OF THE INVENTION

1. Field of the Invention

The invention relates to a method for casting a cast part according to the tilt pouring principle, whereby molten metal is poured from at least one tiltable casting vessel into a casting mold comprising a mold cavity which forms the cast part.

2. Description of the Related Art

A tilt pouring method is disclosed in WO2010/058003A1. Based on this known method, the casting process is set in motion by tilting the casting vessel. At this stage, the casting vessel and the level of the melt in the casting vessel is higher than the casting mold so that the melt enters the casting vessel with relatively high kinetic energy. Based on this known solution, as is usually the case with methods of this type, the melt is ladled out of the bale-out furnace by means of a ladle and then poured out of the ladle into the casting vessel by means of which the casting mold is then filled.

What is problematic with this known method, amongst other things, is that even before starting the process of casting the molten metal from the casting vessel into the casting mold, the fact that the casting vessel is filled by means of the ladle leads to turbulence in the melt causing the metal oxide skin and molten metal to mix, which can have a very detrimental effect on the microstructure of the resultant cast part.

SUMMARY OF THE INVENTION

Accordingly, it is an objective of the invention to propose a new tilt casting method which does not have the aforementioned problems.

This objective is achieved by the invention on the basis of a method of the type outlined above, whereby the molten metal is ladled directly out of a bale-out furnace using the casting vessel, and a metal oxide skin forms in the casting vessel on the surface of the molten metal, and the casting vessel containing the molten metal and the metal oxide skin floating thereon is brought to the casting mold and the molten metal is poured from the casting vessel into the casting mold by a common rotation of the casting vessel and the casting mold about an axis of rotation from an initial position into a final position, the metal oxide skin floating predominantly on top of the molten metal during the pouring process and substantially remaining on the surface of the molten metal.

The solution proposed by the invention results in a particularly homogeneous pouring operation with little turbulence. This very easily enables irregularities in the material structure of the cast part to be prevented. Above all by not pouring the melt from the ladle into the casting vessel, the melt can be ladled and moved to the casting mold with very little turbulence. Since the molten metal has already settled before being poured from the casting vessel into the casting mold, the melt can also be poured into the casting mold very uniformly and free of turbulence. Pouring takes place at such a speed that the metal oxide skin floats on the molten metal until the end of the pouring operation. This ensures uniform pouring of the molten metal into the casting mold.

Pouring with very little turbulence can be achieved due to the fact that at least 80% of the metal oxide skin floats on the surface of the molten metal.

It has proved to be of particular advantage if the metal oxide skin remains in the casting vessel until the final position is reached. In this respect, it is of particular advantage if a region of the metal oxide skin remote from the casting mold is the last to leave the casting vessel on reaching the final position and moves so that it lies on the surface of the molten metal in the casting mold.

More than 80%, preferably more than 95%, of the metal oxide skin advantageously moves so that it lies in the region of a feed of the casting mold in a solidification position which, in terms of time, is reached after the final position.

Based on one variant of the invention by means of which the resultant cast part is of particularly high quality, pouring takes place at such a speed that the metal oxide skin remains elastic and intact until the final position is reached.

Pouring with very little turbulence can be achieved due to the fact that the surface of the metal oxide skin disposed in the casting vessel becomes larger during the process of pouring the molten metal from the casting vessel into the casting mold. This embodiment guarantees that the molten metal is poured at an optimum speed.

Based on another preferred embodiment which enables very exact and defined pouring, the casting vessel can be connected to the casting mold prior to pouring and a relative position of the casting vessel with respect to the casting mold can be maintained between the initial position and the final position during the pouring process.

Optimum setting behavior of the molten metal in the casting mold can be achieved due to the fact that the axis of rotation extends through the casting mold in the initial position and either lies below the mold cavity or, as viewed from the casting vessel, extends behind the mold cavity or through the mold cavity or above the mold cavity.

Based on another embodiment of the method proposed by the invention, in order to prevent the cast part from being damaged by the metal oxide skin, the metal oxide skin on reaching the final position drops onto a feed of the casting mold or slides into it across its entire width.

Based on one variant of the invention which is characterized by particularly calm pouring of the molten metal from the casting vessel into the casting mold with little turbulence, the casting vessel can be moved to the feed of the casting mold after ladling the molten metal out of the bale-out furnace, and the casting vessel has a pour-out region via which the molten metal is poured through the feed into the casting mold, and the contour of the pour-out region corresponds to the contour of a section of the feed lying at the bottom in the initial position as viewed in the vertical direction, and the pour-out region is connected directly to and in alignment with the feed.

It has proved to be of particular advantage if in the initial position, the contour of the feed and the contour of the pour-out region are disposed in a horizontal position or are pivoted out of the horizontal position by an angle of at most 30°.

Very good results in terms of the quality of the cast part can be achieved due to the fact that in the final position, the contour of the feed and the contour of the pour-out region are rotated by an angle of at most 120° and at least 60° relative to the initial position.

It has proved to be of particular advantage if the casting vessel is connected to the casting mold directly on completion of filling with molten metal within a period of at most 5 seconds, in particular within a period of at most 3.5 seconds, and moved into the initial position. The short docking time of the casting vessel on the casting mold enables an optimum casting temperature of the molten metal and optimum flow behavior thereof to be guaranteed. Optimum elastic properties of the metal oxide skin can also be achieved on the basis of the specified times.

A state of the metal oxide skin as well the molten metal that is optimum for pouring can be achieved due to the fact that the casting vessel in the bale-out furnace is filled with the molten metal within a period having a duration of at most 3.5 seconds.

Very good results in terms of the microstructure of the cast part can be achieved due to the fact that the casting vessel and the casting mold are moved from the initial position into the final position within a period of at most 8 seconds, in particular within a period of at most 6.5 seconds.

It has proved to be of particular advantage if an average temperature of the molten metal in the bale-out furnace has a value selected from a range with a lower limit of 680° Celsius and an upper limit of 780° Celsius.

The molten metal can be ladled out of the bale-out furnace gently, with very little turbulence and little oxide due to the fact that, in addition to the aforementioned time specified for ladling the molten metal, the casting vessel has a slit-shaped opening in a region facing away from the casting mold in the initial position, and in order to ladle the molten metal out of the bale-out furnace, the casting vessel is dipped into the molten metal disposed in the bale-out furnace with the opening out in front.

Based on another very advantageous variant of the invention, the casting vessel and the casting mold may be moved from the initial position into the final position in an atmosphere above atmospheric pressure.

Based on one embodiment that is optimum in terms of productivity and short process times, at least three casting molds disposed on a carousel may be used, and the carousel rotates the three casting molds in turn from a casting position in which the molten metal is poured from the casting vessel into the casting mold into a solidification position in which the molten metal solidifies in the casting mold, and then into an operating position in which the casting mold is opened and a cast part removed from the casting and the casting mold is cleaned. Based on another advantageous embodiment, another option is to operate two carousels in parallel.

A very high productivity and an optimum quality of the resultant cast parts can be achieved by rotating the carousel in a constantly timed cycle having a value selected from a range with a lower limit of 70 seconds and an upper limit of 80 seconds.

To provide a clearer understanding, the invention will be described in more detail below with reference to the appended drawings.

BRIEF DESCRIPTION OF THE DRAWINGS

These are highly simplified, schematic diagrams illustrating the following.

DETAILED DESCRIPTION OF THE PREFERRED EMBODIMENTS

Figure 1:
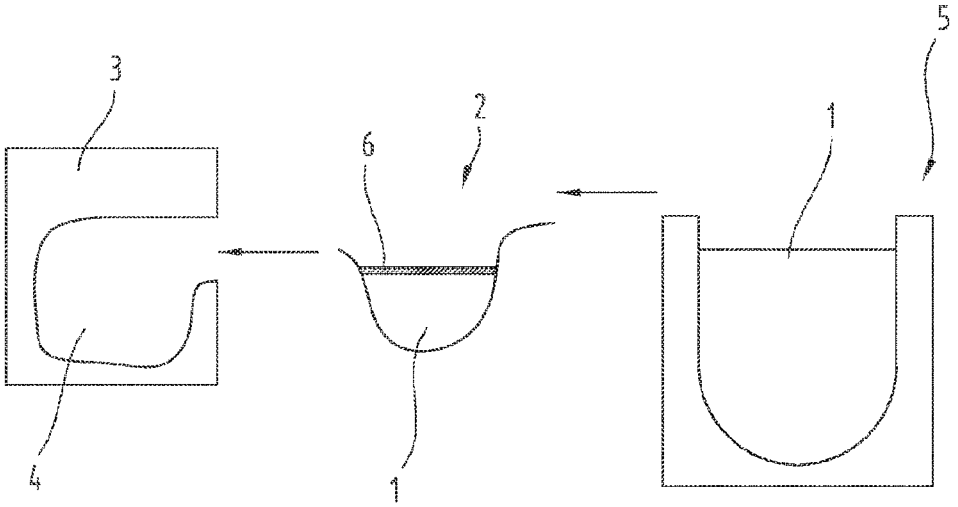
FIG. 1 a casting vessel, a casting mold and a bale-out furnace as used for a method proposed by the invention.

Firstly, it should be pointed out that the same parts described in the different embodiments are denoted by the same reference numbers and the same component names and the disclosures made throughout the description can be transposed in terms of meaning to same parts bearing the same reference numbers or same component names. Furthermore, the positions chosen for the purposes of the description, such as top, bottom, side, etc., relate to the drawing specifically being described and can be transposed in terms of meaning to a new position when another position is being described.

The embodiments illustrated as examples represent possible variants of the solution proposed by the invention and it should be pointed out at this stage that the invention is not specifically limited to the variants specifically illustrated, and instead the individual variants may be used in different combinations with one another and these possible variations lie within the reach of the person skilled in this technical field given the disclosed technical teaching.

Furthermore, individual features or combinations of features from the different embodiments illustrated and described may be construed as independent inventive solutions or solutions proposed by the invention in their own right.

The objective underlying the independent inventive solutions may be found in the description.

All the figures relating to ranges of values in the description should be construed as meaning that they include any and all part-ranges, in which case, for example, the range of 1 to 10 should be understood as including all part-ranges starting from the lower limit of 1 to the upper limit of 10, i.e. all part-ranges starting with a lower limit of 1 or more and ending with an upper limit of 10 or less, e.g. 1 to 1.7, or 3.2 to 8.1 or 5.5 to 10.

Figure 6:
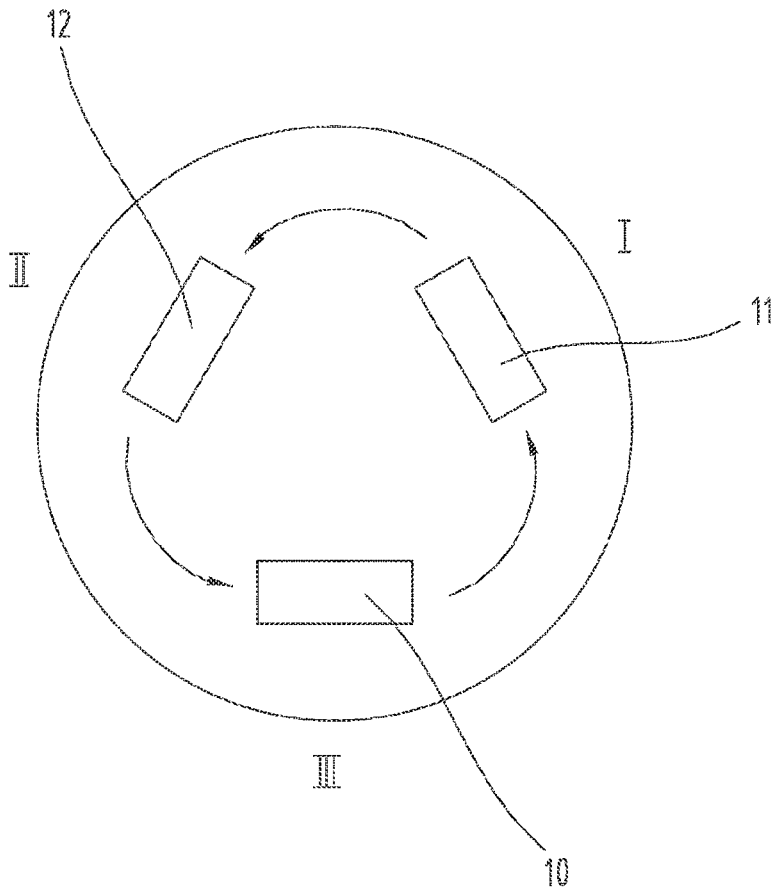
FIG. 6 a carousel with three casting molds.

Above all, the embodiment of the subject matter illustrated in FIG. 6 may be construed as an independent invention in its own right. The associated objectives and inventive solutions may be found in the detailed description of this drawing.

For the sake of good order, finally, it should be pointed out that, in order to provide a clearer understanding of the structure of the components of the casting device used to implement the method, they and their constituent parts are illustrated to a certain extent out of scale and/or on an enlarged scale and/or on a reduced scale.

Figure 2:
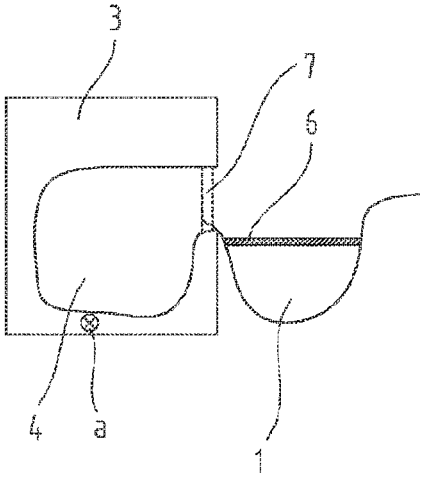
FIG. 2 an initial position of the casting vessel and casting mold from FIG. 1 prior to pouring a molten metal from the casting vessel into the casting mold.
Figure 3:
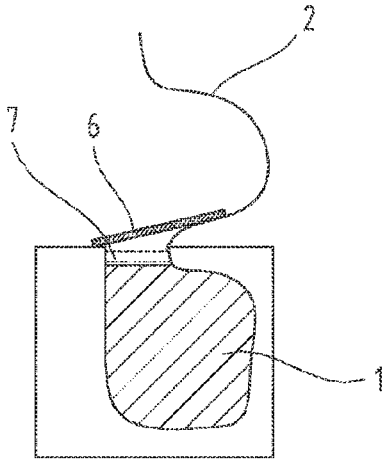
FIG. 3 a final position of the casting vessel and casting mold from FIG. 2 after pouring the molten metal out of the casting vessel into the casting mold.

As illustrated in FIGS. 1-3, casting based on the inventive method for casting a cast part takes place according to the tilt pouring principle. To this end, a molten metal 1 is poured from a tiltable casting vessel 2 into a casting mold 3 having a mold cavity 4 which forms the cast part. By particular preference, the molten metal 1 is an aluminum alloy, for example AC-Al Si 10 Mg (Cu), AC-Al Si8 Cu3, Al Si7 Cu3, Al Si6 Cu4. By particular preference, the casting mold 3 is a casting mold for producing aluminum components that are subject to high stress such as, for example, cylinder heads or other components for automotive vehicles.

In FIGS. 1-3, the casting vessel 2 and casting mold 3 are illustrated in different successive positions in time. Pouring may also take place by means of two or more casting vessels 2, also referred to as casting ladles, disposed parallel with one another.

The casting vessel 2 is preferably moved to the casting mold 3 and connected to it by means of a robot arm, for example suspended in it. After connecting the casting vessel 2 to the casting mold 3, the robot arm can release the casting vessel 2 and is then available for another operation. The casting vessel 2 is preferably also filled by means of the robot arm, which dips the casting vessel 2 into the molten metal 1 of the bale-out furnace 5. Accordingly, the molten metal 1 is ladled directly out of a bale-out furnace 5 by means of the casting vessel 2. During ladling or immediately thereafter, a metal oxide skin 6 forms in the casting vessel 2 on the surface of the molten metal 1. An average temperature of the liquid molten metal 6 disposed in the bale-out furnace 5 has a value selected from a range with a lower limit of 680° Celsius and an upper limit of 780° Celsius.

Having been filled, the casting vessel 2 containing the molten metal 1 and the metal oxide skin 6 floating on it is moved to the casting mold 3. The molten metal 1 is then poured from the casting vessel 2 into the casting mold 3 by a common rotation of the casting vessel 2 and casting mold 3 from an initial position into a final position about an axis of rotation a. During the pouring operation, the metal oxide skin 6 is predominantly floating, up to at least 80% or entirely floating, on the molten metal 1 and remains substantially on the surface of the molten metal until the final position is reached.

Based on one variant of the invention, the metal oxide skin 6 may also remain in the casting vessel 2 until the final position is reached. A region of the metal oxide skin 6 remote from the casting mold 3 is the last to leave the casting vessel 2 on reaching the final position and moves so that it lies on the surface of the molten metal 1 in the casting mold 3. More than 80%, preferably more than 95%, of the metal oxide skin 6 ends up in the region of a feed 7 of the casting mold 3 in the solidification position which follows the final position in time.

Up until the final position is reached, the metal oxide skin 6 remains elastic and intact. As the molten metal 1 is being poured, the surface of the metal oxide skin 6 disposed in the casting vessel 2 may also become larger, especially in the direction of a region from which it is poured out of the casting vessel 2. As a result of the surface of the metal oxide skin becoming larger during the pouring process, a particularly calm flow of the molten metal is obtained.

Before pouring, the casting vessel 2 is connected to the casting mold 3. A relative position of the casting vessel 2 with respect to the casting mold 3 is maintained between the initial position and the final position during the pouring process. In other words, the casting vessel 2 follows a movement of the casting mold 3 about the axis of rotation a. It has proved to be of particular advantage if the axis of rotation a extends through the casting mold 3 in the initial position. In this respect, the axis of rotation a may lie either below the mold cavity 4 or, as viewed from the casting vessel 2, may extend behind the mold cavity 4 or through the mold cavity 4 or above the mold cavity 4.

At the pouring-in side, the casting mold 3 may be provided with a feed 7. This being the case, after ladling the molten metal 1 out of the bale-out furnace 5, the casting vessel 2 can be moved to the feed 7 of the casting mold 3 and connected to this feed 7. The casting vessel 2 has a pour-out region 8 via which the molten metal 1 is poured into the feed 7 and from there into the mold cavity 4. The contour of the pour-out region 8 corresponds to the contour of a section of the feed 7 lying at the bottom in the initial position, as viewed in the vertical direction. The pour-out region 8 is preferably connected directly to and in alignment with the feed 7. By contour in this connection is primarily meant the shape of a base region and the mutually abutting outer edges and external faces of the feed 7 and pour-out region 8 of the casting vessel 2.

On reaching the final position, the metal oxide skin 6 drops onto the feed 7 of the casting mold 3 or slides into the feed 7. Preferably, the metal oxide skin slides substantially across the entire width of and into the feed 7.

Figure 4:
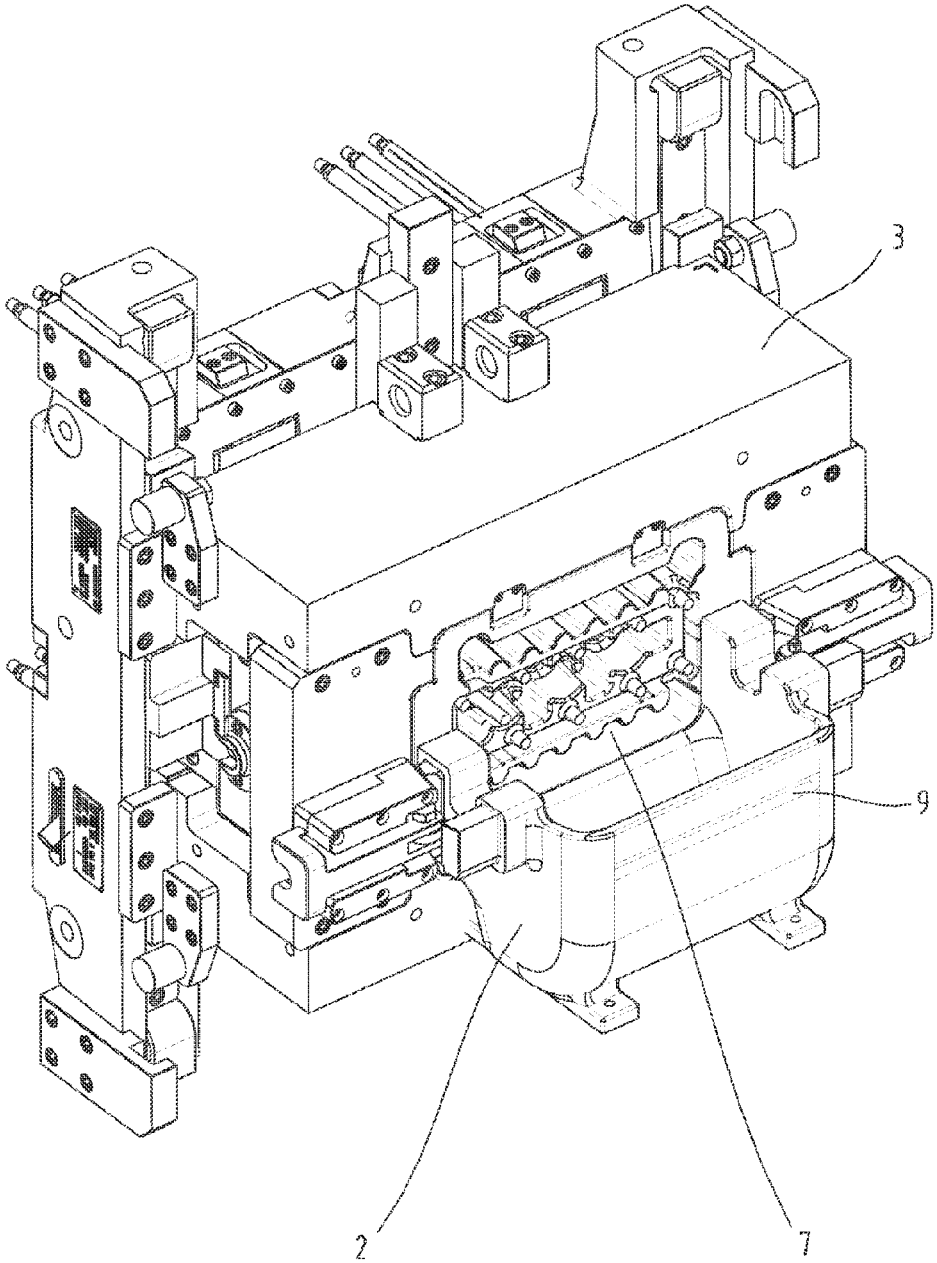
FIG. 4 a perspective view of the casting vessel and the casting mold from FIG. 2.

As illustrated in FIG. 4, the casting vessel 2 may be provided with a slit-shaped opening 9 in a region facing away from the casting mold 3 in the initial position. In order to ladle the molten metal 1 out of the bale-out furnace 5, the casting vessel 2 is dipped into the molten metal 1 disposed in the bale-out furnace 5 with the opening 9 disposed out in front. The slit-shaped opening 9 which extends vertically in the molten metal 1 of the bale-out furnace 5 during the ladling operation ensures that only clean, oxide-free metal flows into the casting vessel 2 during the ladling operation. The time taken to fill the casting vessel 2 with molten metal 1 from the bale-out furnace 5 is a period of at most 3.5 seconds.

Immediately after having been filled with molten metal 1, the casting vessel 2 is connected to the casting mold 3 and moved into the initial position within a period of at most 5 seconds, in particular within a period of at most 3.5 seconds.

Figure 5:
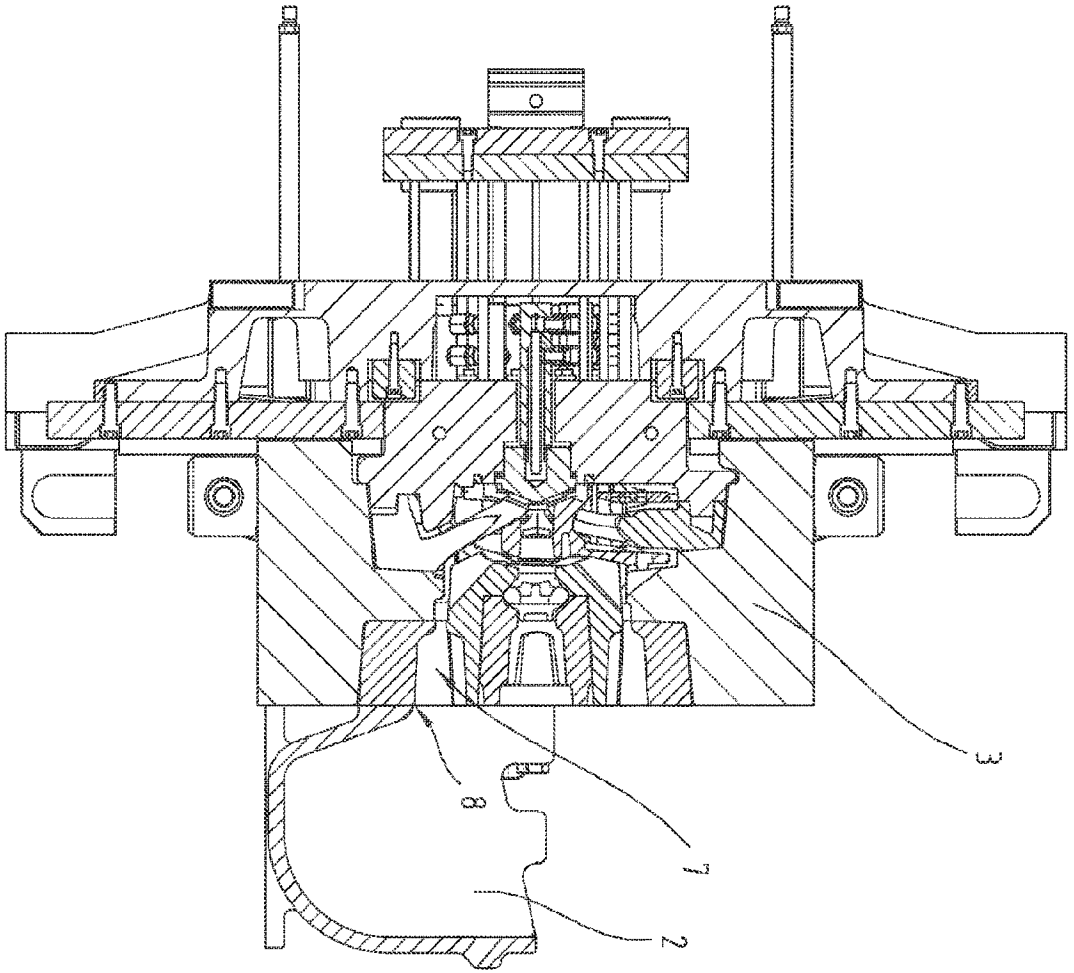
FIG. 5 a section through the casting vessel and casting mold from FIG. 4.

As may be seen from FIG. 5, the contour of the feed 7 and the contour of the pour-out region 8 are disposed in a horizontal position in the initial position. At this stage, however, it should be pointed out that the contours of the feed 7 and pour-out region in the initial position can also be pivoted out of the horizontal position about an axis of rotation a by an angle of up to at most 30°. In the final position, the contour of the feed 7 and the contour of the pour-out region 8 are rotated by an angle of at most 120° and at least 60° relative to the initial position. The casting vessel 2 and casting mold 3 are moved from the initial position into the final position within a period of at most 8 seconds, in particular within a period of at most 6.5 seconds.

At this stage, it should also be pointed out that the entire method proposed by the invention or only the step of pouring the molten metal 1 out of the casting vessel 2 into the casting mold 3 may be operated at a pressure above atmospheric pressure. In order to create the overpressure, the casting vessel 2 and casting mold 3 may be placed in a closed chamber which can be filled with a gas or gas mixture, for example an inert gas, thereby generating a pressure above the ambient pressure outside the chamber. In principle, the bale-out furnace 5 could also be disposed in the chamber.

The embodiment illustrated in FIG. 6 comprises at least three casting molds 10, 11, 12 disposed on a carousel. This embodiment represents an independent embodiment which may also be used with casting methods other than that described above. The carousel rotates the three casting molds 10, 11, 12 in turn from a casting position I in which the molten metal 1 is poured from the casting vessel 2 into the casting mold 10, 11, 12 into a solidification position II in which the molten metal 1 in the casting mold 10, 11, 12 solidifies and then into an operating position III in which the casting mold 10, 11, 12 is opened and a cast part removed from the casting mold 10, 11, 12 and the casting mold 10, 11, 12 is cleaned. The carousel continues to rotate in a constantly timed cycle having a value selected from a range with a lower limit of 70 seconds and an upper limit of 80 seconds. Based on a preferred embodiment, this cycle is 75 seconds and is made up as follows: in the casting position I, the process of docking the casting vessel 2 on the casting mold 11 takes 3.5 seconds, whereas tilting the casting vessel 2 and the casting mold 11 from the initial position into the final position takes 6.5 seconds. On reaching the final position, the casting vessel is undocked from the casting mold and is available for another ladling operation again. For another 56 seconds, the molten metal in the casting position I solidifies. Another 9 seconds are needed to rotate the casting mold 11 into position II.

In the solidification position II, the molten metal 1 or cast part in the casting mold 10 solidifies for a further 66 seconds, and another 9 seconds are needed for the rotation into the operating position III. In the operating position, the cast part solidifies for a further 10 seconds, 9 seconds are needed to open the casting mold and 8 seconds for removing the cast part by means of a robot. Cleaning of the casting mold 3 takes 20 seconds and placing in a new sand core takes 10 seconds. In order to close the casting mold 3 and rotate it into the casting position I, 9 seconds are needed in each case. This results in a cycle time of 75 seconds to rotate from one of positions I, II, III into the next position.

LIST OF REFERENCE NUMBERS

1 Molten metal
2 Casting vessel
3 Casting mold
4 Mold cavity
5 Bale-out furnace
6 Metal oxide skin
7 Feed
8 Pour-out region
9 Opening
10 Casting mold
11 Casting mold
12 Casting mold
a Axis of rotation
I Casting position
II Solidification position
III Operating position

The invention claimed is:

1. Method for casting a cast part according to a tilt pouring principle, whereby a molten metal is poured from at least one tiltable casting vessel into a casting mold comprising a mold cavity which forms the cast part, wherein the molten metal is ladled directly out of a bale-out furnace using the at least one tiltable casting vessel, and a metal oxide skin forms in the at least one tiltable casting vessel on the surface of the molten metal, and the at least one tiltable casting vessel containing the molten metal and the metal oxide skin floating thereon is brought to the casting mold and the molten metal is poured from the at least one tiltable casting vessel into the casting mold by a common rotation of the at least one tiltable casting vessel and casting mold about an axis of rotation from an initial position into a final position, and the metal oxide skin predominantly floats on top of the molten metal and remains on the surface of the molten metal during a pouring process, wherein the at least one tiltable casting vessel is provided with a slit-shaped opening in a region facing away from the casting mold in the initial position, and in order to ladle the molten metal out of the bale-out furnace, the at least one tiltable casting vessel is dipped into the molten metal disposed in the bale-out furnace with the opening disposed out in front.

2. Method according to claim 1, wherein at least 80% of the metal oxide skin floats on the surface of the molten metal.

3. Method according to claim 1, wherein the metal oxide skin remains in the at least one tiltable casting vessel until the final position is reached.

4. Method according to claim 1, wherein a region of the metal oxide skin remote from the casting mold is the last to leave the at least one tiltable casting vessel on reaching the final position and moves so that it lies on the surface of the molten metal in the casting mold.

5. Method according to claim 1, wherein more than 80% of the metal oxide skin ends up in the region of a feed of the casting mold in a solidification position which follows the final position in time.

6. Method according to claim 1, wherein the metal oxide skin remains elastic and intact until the final position is reached.

7. Method according to claim 1, wherein the surface of the metal oxide skin disposed in the at least one tiltable casting vessel becomes larger during the process of pouring the molten metal from the at least one tiltable casting vessel into the casting mold.

8. Method according to claim 1, wherein the at least one tiltable casting vessel is connected to the casting mold prior to pouring and a relative position of the at least one tiltable casting vessel with respect to the casting mold is maintained between the initial position and the final position during the pouring process.

9. Method according to claim 1, wherein the axis of rotation extends through the casting mold in the initial position and either lies below the mold cavity or, as viewed from the at least one tiltable casting vessel, extends behind the mold cavity or through the mold cavity or above the mold cavity.

10. Method according to claim 1, wherein on reaching the final position, the metal oxide skin drops onto a feed of the casting mold or slides into it.

11. Method according to claim 10, wherein after ladling the molten metal out of the bale-out furnace, the at least one tiltable casting vessel is moved to the feed of the casting mold, and the at least one tiltable casting vessel has a pour-out region via which the molten metal is poured through the feed into the casting mold, and a contour of the pour-out region corresponds to the contour of a section of the feed disposed at a bottom in the initial position as viewed in the vertical direction, and the pour-out region is connected directly to and in alignment with the feed.

12. Method according to claim 11, wherein the contour of the feed and the contour of the pour-out region are disposed in a horizontal position in the initial position or are pivoted out of the horizontal position by an angle of at most 30°.

13. Method according to claim 12, wherein in the final position, the contour of the feed and the contour of the pour-out region are rotated by an angle of at most 120° and at least 60° relative to the initial position.

14. Method according to claim 1, wherein immediately after having been filled with molten metal, the at least one tiltable casting vessel is connected to the casting mold and moved into the initial position within a period of at most 5 seconds.

15. Method according to claim 1, wherein the at least one tiltable casting vessel is filled with molten metal from the bale-out furnace within a period having a duration of at most 3.5 seconds.

16. Method according to claim 1, wherein the at least one tiltable casting vessel and casting mold are moved from the initial position into the final position within a period of at most 8 seconds.

17. Method according to claim 1, wherein an average temperature of the molten metal in the bale-out furnace has a value selected from a range with a lower limit of 680° Celsius and an upper limit of 780° Celsius.

18. Method according to claim 1, wherein the at least one tiltable casting vessel and casting mold are moved from the initial position into the final position at a pressure above atmospheric pressure.

19. Method according to claim 1, wherein at least three casting molds are used, disposed on a carousel, and the carousel rotates the three casting molds in turn from a casting position in which the molten metal is poured from the at least one tiltable casting vessel into the casting mold, into a solidification position in which the molten metal solidifies in the casting mold and then into an operating position in which the casting mold is opened and a cast part is removed from the casting mold, and the casting mold is cleaned.

20. Method according to claim 19, wherein the carousel is rotated in a constantly timed cycle having a value selected from a range with a lower limit of 70 seconds and an upper limit of 80 seconds.

* * * * *